United States Patent [19]

Cristea

[11] 4,411,049

[45] Oct. 25, 1983

[54] RETAINER STRAP

[76] Inventor: Norm E. Cristea, 2801 Barkman, Pontiac, Mich. 48055

[21] Appl. No.: 217,030

[22] Filed: Dec. 16, 1980

[51] Int. Cl.[3] ..... B65D 63/02

[52] U.S. Cl. ..... 24/20 EE; 24/16 PB

[58] Field of Search ..... 24/16 PB, 17 A, 16 R, 24/20 R, 20 W, 20 EE, 21, 23 R, 23 W, 265 A; 248/74 PB

[56] References Cited

U.S. PATENT DOCUMENTS

| | | | |
|---|---|---|---|
| 912,820 | 2/1909 | Davis | 24/20 EE |
| 1,084,407 | 1/1914 | Deist | 24/20 EE |
| 2,451,554 | 10/1948 | Hedstrom | 24/129 B |
| 2,936,980 | 5/1960 | Rapata | 248/74 PB |
| 2,954,631 | 10/1960 | McMurray | 24/129 B |
| 2,959,098 | 11/1960 | Hassman . | |
| 3,022,557 | 2/1962 | Logan | 24/17 |
| 3,086,265 | 4/1963 | Orenick et al. . | |
| 3,216,079 | 11/1965 | Keyworth | 24/20 EE |
| 3,324,234 | 6/1967 | Hervig . | |
| 3,964,133 | 6/1976 | Wasserlein, Jr. . | |

FOREIGN PATENT DOCUMENTS

| | | | |
|---|---|---|---|
| 1490275 | 12/1968 | Fed. Rep. of Germany . | |
| 514372 | 3/1921 | France | 24/16 PB |

*Primary Examiner*—Robert A. Hafer

*Attorney, Agent, or Firm*—Harness, Dickey & Pierce

[57] ABSTRACT

This disclosure relates to a retainer strap for use in holding together and/or supporting wires, hoses, ropes, or the like. The strap comprises a head portion and a tail portion. The head portion is comprised of a section of the strap folded substantially onto itself so that two spaced-apart apertures in this portion of the strap are substantially aligned with one another. The tail portion is adapted to be inserted through the apertures in the head portion to form a loop of adjustable size. After being looped, the retainer strap may be placed in either holding or locking configurations. No tools are required to either install or lock the strap of the present invention.

9 Claims, 11 Drawing Figures

RETAINER STRAP

BACKGROUND AND SUMMARY OF THE INVENTION

The present invention pertains primarily to fastening or retaining devices and more particularly to bundling or retaining straps.

It has generally been the practice to manufacture certain types of bundling or retaining straps out of various plastic materials and to provide locking or securing mechanisms of some type on the plastic strap. For example, a metal tooth-like member may be provided as part of the strap assembly to help prevent the strap from backing out of its desired position. In such cases, the metal tooth-like member would engage a portion of the plastic strap in such a way that inward movement of the strap (into locking engagement) would be relatively simple. However, any efforts to remove the strap would cause the metal tooth-like member to destructively engage the plastic strap. Plastic straps of this type are commonly used in bundling light-duty electrical or telephone wires. Other plastic constructions often comprise relatively elaborate geometric locking arrangements of some type wherein resilient tabs on the plastic strap deformably slip through holes in the strap, and once forced through, the larger tabs are prevented from backing out of the smaller holes in the strap.

It has also been the practice to manufacture other types of bundling or retaining straps out of metal. However, it has usually been necessary to provide somewhat complicated locking or securing mechanisms thereon. For example, separate screw-type locking means are often provided on metal straps to secure the strap using a gear-like mechanism. Such metal straps are commonly used in securing rubber hoses on automobiles. It has also been common in lighter duty applications to provide a metal clip of some type which at least partially surrounds the metal strap and which engages the metal strap to lock it in place by preventing back-out. Often, the metal strap may be serrated so as to engage an anti-back-out device on the clip. In yet other instances, such as in package bundling operations, the metal strap and accompanying metal clip might be deformed or pierced-out in such a way as to lock them together. Needless to say, this latter method requires destruction of the strap to release the bundled package.

In both of the above-described types of constructions, namely plastic or metal, it is necessary in many instances to manufacture the straps in relatively complicated configurations so that certain geometrical relationships exist in the finished strap. In other instances, separate locking mechanisms must either be built in to the strap assembly or be added to the strap before use. This of course represents significant additional cost. In yet other cases, various tools are necessary to install or lock the strap. This also represents additional time, inconvenience, and expense.

Accordingly, it is a principle object of the present invention to provide an improved retainer strap construction which is relatively simple to manufacture, simple to use, and yet provides a secure method of holding together or supporting wires, hoses, ropes, or the like.

In general, the retainer strap according to the present invention contemplates the use of a retainer strap comprised of a head portion and a tail portion. The head portion is comprised of a section of the strap folded substantially onto itself so that two spaced-apart apertures in this portion of the strap are in substantial alignment with one another. The tail portion is adapted to be inserted through the apertures in the head portion to form a loop of adjustable size. After being looped, the retainer strap of the present invention may be placed in either a holding configuration or a locking configuration.

Additional advantages and features of the present invention will become apparent from a reading of the detailed description of the preferred embodiments which makes reference to the following set of drawings in which:

DESCRIPTION OF THE PREFERRED EMBODIMENTS

Figures 1, 2, 3A, 3B, 4A, 4B, 5A, 5B, 6, 7A, 7B:
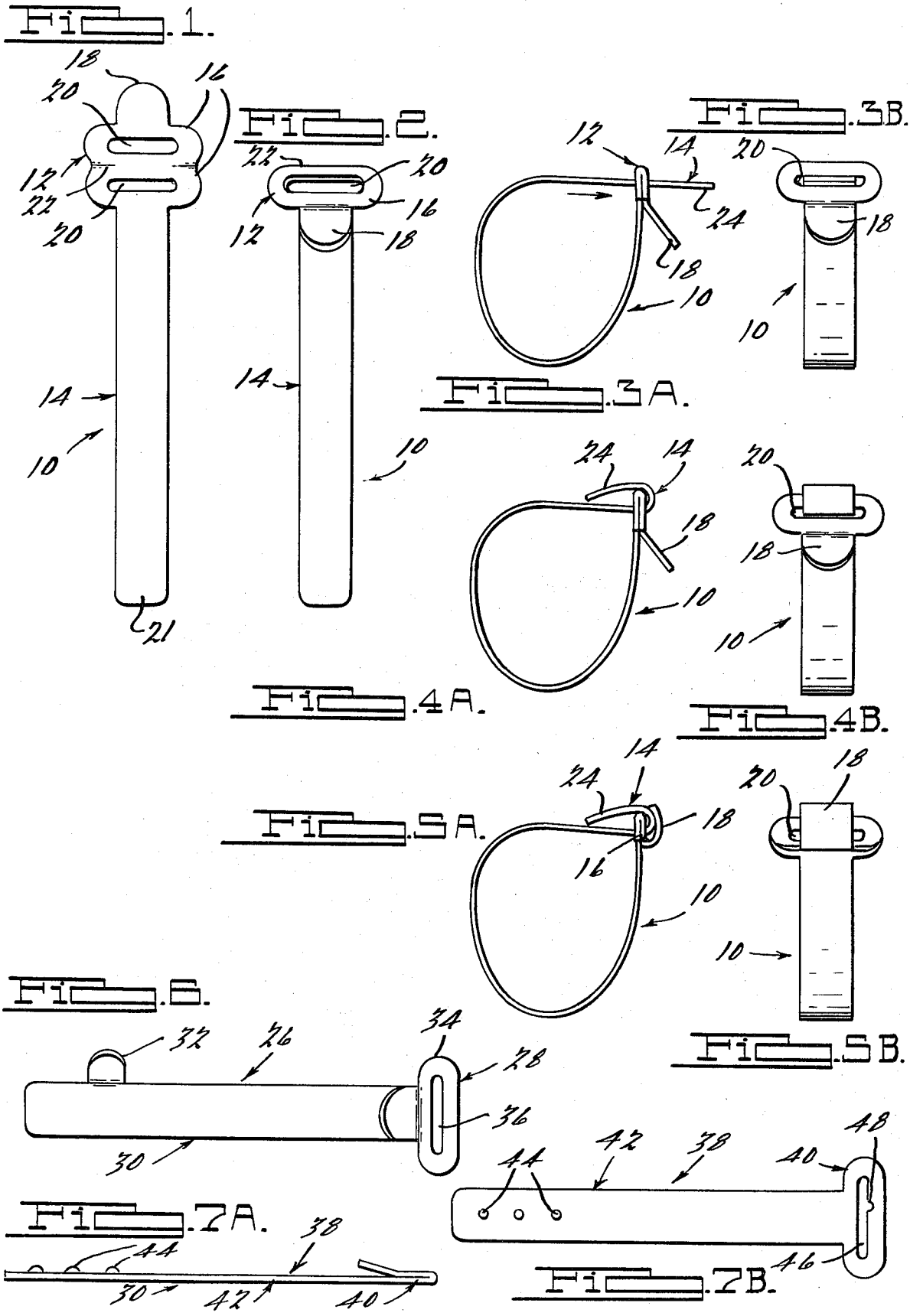
FIG. 1 is a plan view of a retainer strap in accordance with the present invention showing the head portion of the strap unfolded.
FIG. 2 is another view of the retainer strap of FIG. 1 showing the head portion folded onto itself.
FIG. 3A is a side view of the retainer strap of FIG. 2 shown formed into a loop.
FIG. 3B is a front view of the retainer strap of FIG. 3A.
FIG. 4A is a side view of the retainer strap of FIG. 3A shown in a holding configuration.
FIG. 4B is a front view of the retainer strap of FIG. 4A.
FIG. 5A is a side view of the retainer strap of FIG. 4A shown in a locking configuration.
FIG. 5B is a front view of the retainer strap of FIG. 5A.
FIG. 6 is a plan view of another embodiment of a retainer strap according to the present invention.
FIG. 7A is a side view of yet another embodiment of a retainer strap according to the present invention.
FIG. 7B is a plan view of the retainer strap of FIG. 7A.

Referring now to the drawings wherein the showings are for the purpose of illustrating preferred embodiments of the present invention and are not for the purpose of limiting the invention, FIG. 1 shows a retainer strap 10 in accordance with the present invention. The strap 10 comprises a head portion 12 and a tail portion 14. FIG. 1 shows the strap 10 in an unfolded configuration as it might look immediately after fabrication, but prior to being folded into its normal operational configuration of FIG. 2. The head portion 12 as shown in FIG. 1 is made up of two generally symmetrical enlarged sections 16 and a tab member 18. Each of the enlarged sections 16 has a slot or aperture 20 therein. These apertures 20 are shown as being centered, both longitudinally and transversely, in their respective enlarged sections 16. As will be explained in somewhat more detail hereinbelow, the position and centering of the apertures 20 help prevent twisting of the body or tail portion 14 along its length during use. The slots or apertures 20 are sized so as to provide only minimal clearance for the tail portion 14 which is inserted therethrough. As shown in this preferred embodiment, the upper aperture 20 may be somewhat larger than the lower aperture so as to facilitate fold-over alignment. Of course, no size difference, or the opposite arrangement with the lower aperture being larger, also provide functional straps. The head portion 12 as shown is approximately twice the width of the body or tail portion 14 of the strap. The body or tail portion 14 of the strap is the same width or thickness through its entire length, although the outermost end 21 may be tapered or rounded for ease of insertion. The longitudinal dimension of each of the enlarged sections 16 of the head portion 12 is approximately the same as the width of the body or tail portion 14. The tab member 18 is of generally the same width as the tail portion 14, and as will be explained in more detail hereinbelow, is used to move the retainer strap 10 of the present invention into its locking configuration.

FIG. 2 shows the retainer strap of FIG. 1 with the head portion 12 being comprised of a section of the strap folded substantially onto itself so that the apertures 20 in the respective enlarged sections 16 are in substantial alignment with one another. As shown in this embodiment, the larger aperture overlays the smaller aperture. In this configuration, the two enlarged sections 16 overlay each other and are connected along a common edge or "waistline" portion 22 which is the portion along which this section of the strap is folded. This folding over of the strap makes the head portion approximately twice the thickness of the body, with this double thickness being formed by the enlarged sections 16 being folded over onto themselves. As will be noted hereinbelow, the retainer strap 10 should be made of a material which retains this folded over shape.

FIGS. 3A, 3B, 4A, 4B, 5A, and 5B illustrate various configurations of the retainer strap 10 of the present invention during use. FIGS. 3A and 3B are side and front views respectively of the retainer strap 10 after it has been formed into a loop. (Needless to say, the retainer strap 10 would first be positioned or wrapped around the items to be bundled or retained.) The loop is formed by inserting or threading the tail portion 14 through the apertures 20 in the head portion 12 in the direction indicated in this figure. Of course, a tapered or rounded end as referred to above would make insertion easier. The formation of this loop results in a free end 24 which extends beyond the head portion 12. It is also believed to be noteworthy that the tab member 18 is shown as being lifted or bent out of the plane of the remainder of the head portion 12. Of course, the free end 24 would normally be pulled through the apertures 20 until the desired tension or closed loop dimension is obtained. Infinite adjustment is possible.

FIGS. 4A and 4B are side and front views respectively of the retainer strap 10 in a "holding" configuration. In this configuration, the free end 24 of the tail portion 14 is folded or bent back onto itself about 180° as shown. In this position, the retainer strap can resist dethreading, unlike the configuration of FIGS. 3A and 3B where the free end 24 may easily be removed through the apertures in the head portion. Needless to say, and as mentioned briefly above, the retainer strap should be formed of a material which is able to maintain this bent over configuration once made.

FIGS. 5A and 5B are side and front views respectively of the retainer strap 10 in a "locking" configuration. In this particular configuration, the free end 24 of the tail portion 14 remains in the folded or bent over position shown in the holding configuration of FIG. 4A, but in addition, the tab member 18 is folded or bent back towards the previously bent over free end 24. In addition to bending back the tab member 18, the adjoining enlarged section 16 may also be bent back somewhat as the tab member 18 is moved so as to be substantially flush with free end 24. It has been found that the "locking" feature of the present strap generally works best with the tab and adjacent head portion bent over at or near the center of the aperture in the head portion.

Referring now to FIG. 6, another embodiment of a retainer strap 26 according to the present invention is shown. This retainer strap 26 is generally the same as the strap 10 of FIGS. 1 and 2 in that it contains a similar head portion 28 and a substantially similar tail portion 30. However, the tail portion 30 of the embodiment of FIG. 6 includes a hold down ear 32 which may be integrally formed with the tail portion 30. The hold down ear 30 as shown is approximately the same shape and width as the corresponding portion of the enlarged sections 34 in the head portion 28. The hold down ear 32 would be used to hold down the free end of the tail portion after the tail portion 30 was threaded or inserted through the aperture 36 and then bent back to form a loop of the type shown in FIG. 4A. The hold down ear would have to be long enough to engage the bent over free end to keep it in "holding" or "locking" configuration, thereby preventing the free end from sticking out and interfering with other nearby items. Of course, the quantity, location, and shape of the ears may be varied to suit the particular application. It has been found that hold down ears may be placed opposite each other on alternate sides of the tail portion to increase holding power, or may be staggered from each other, in which case their longitudinal dimensions may be reduced if desired.

FIGS. 7A and 7B show yet another embodiment of a retainer strap 38 according to the present invention. This retainer strap 38 is generally the same as the strap 10 of FIGS. 1 and 2 in that it contains a substantially similar head portion 40 and a substantially similar tail portion 42. However, the tail portion 42 includes a series of locking ramps or locking bumps 44 which may be integrally formed with the tail portion 42. the bumps 44 provide for finite adjustment of the loop size unlike the infinite loop adjustment of the embodiments of FIGS. 1 to 6. As shown in FIG. 7B, the locking bumps are positioned on the longitudinal center-line of the tail portion 42, although they may also be positioned off the center-line or in pairs, multiples, or the like. The head portion 40 contains an aperture 46 which is shaped or keyed with a key slot 48 so as to receive the locking bumps 44 when the tail portion 42 is inserted or threaded into the head portion. The key slot 48 is positioned off the longitudinal center line, and the slot or aperture 46 is slightly longer to facilitate engagement. Once the tail portion 42 and accompanying bumps 44 are inserted through the head portion and key slot 48, which may be accomplished by inserting the tail at an angle to the head to allow for passage of the bumps through the offset key slot, a secure fit should be provided and loss of tension should be prevented. Back-out interference is provided when the tail portion 42 is centered in the slot or aperture 46. This prevents the tail from passing back out through the key slot. Needless to say, other bump, ramp, or alternate keying arrangements are believed to be usable in carrying out this aspect of the present invention.

With regard to particular materials which are believed to be usable in making the retainer strap of the present invention, it has been found that 1100 series aluminum performs well in that it is relatively easy to fabricate, is relatively ductile, strong, flexible, and deformable, and is able to maintain a bent-over configuration without springing back. In addition, this type of material performs well over a wide temperature range, thus making the present retainer strap usable in a great variety of applications. It is also reusable within the physical limits of the material. Of course it should be appreciated that since most metals have certain fatigue characteristics, a retainer strap made from 1100 series aluminum or the like may be reusable only a limited number of times. Other materials, both metals and non-metals with similar performance properties are also believed to be usable for making the retainer straps of the present invention.

Of course, the length of the tail portion or the other dimensions of the retainer strap of the present invention may be varied for different bundling or retaining applications. In addition, certain size configurations may provide different manufacturing advantages. For example, if the head portions are the same size, then they may be stamped out after folding. This may reduce stamping die costs. Also, if the head portions are folded over first, then the apertures can be pierced at the same time.

In order to further enhance performance and appearance of the retainer strap of the present invention, various coatings such as nylon, vinyl, rubber, or other conventional plastic materials may be applied to the tail portion of the strap to protect the bundled or retained items from a cutting action by the strap. The coatings should be flexible and bondable and may be applied using conventional coating application techniques including hot dipping, flow coating, spraying, or the like. The coating thickness, when passed through the head portion, would add holding and locking power by its interference with the apertures. The apertures should be sized to permit the coated tail to pass through with minimum clearances. In addition, the coatings may also provide insulating properties or may be color-coded for various sizes and applications.

In order to further protect the bundled or retained items, the edges of the tail may be rounded or polished to provide added protection from cutting or abrading the bundled items.

Among the advantages of the present invention, in addition to those described above, is that a retainer strap is provided which is relatively simple to use. No tools are required to either install or lock the strap of the present invention. Since the retainer strap is relatively simple in shape it is easy to manufacture, thus making it very attractive from an economic standpoint. Also, since the retainer strap can be either placed in a holding configuration or a locking configuration, various uses are possible, and reusability is also enhanced.

While it will be apparent that the preferred embodiments of the invention disclosed are well calculated to fulfill the objects above stated, it will be appreciated that the invention is susceptible to modification, variation, and change without departing from the proper scope or fair meaning of the subjoined claims.

What is claimed is:

1. A retainer strap comprising a head portion and a tail portion, said head portion having two spaced-apart apertures therethrough and being comprised of a section of said strap folded substantially onto itself so that said apertures are in substantial alignment with one another, and said tail portion being adapted to be inserted through said apertures to form a loop, and wherein a free end of said tail portion is foldable onto itself after being inserted through said apertures to put the loop in a holding configuration, and wherein a tab member formed on the end of said strap opposite said tail portion is foldable onto a portion of said folded free end to put the loop in a locking configuration, and wherein part of said head portion is also foldable with said tab member.

2. The invention of claim 1 wherein said tail portion includes at least one hold down ear.

3. The invention of claim 1 wherein said tail portion includes at least one locking bump and wherein said apertures in said head portion include a key slot positioned off the longitudinal center line of said strap and adapted to receive said locking bump when said strap is formed into a loop.

4. The invention of claim 1 wherein said strap is made from aluminum.

5. The invention of claim 1 wherein said head portion is approximately twice the width of said tail portion.

6. The invention of claim 1 wherein said head portion further comprises a tab member formed on the end of said strap opposite said tail portion.

7. The invention of claim 1 wherein one of said two spaced-apart apertures is larger than the other of said apertures to facilitate fold-over alignment.

8. The invention of claim 1 wherein the outermost end of said tail portion is tapered for ease of insertion into said apertures.

9. The invention of claim 1 wherein said retainer strap includes a protective coating thereon.

* * * * *